US007517066B1

(12) United States Patent
Gao et al.

(10) Patent No.: US 7,517,066 B1
(45) Date of Patent: Apr. 14, 2009

(54) PRINTER INCLUDING TEMPERATURE GRADIENT FLUID FLOW DEVICE

(75) Inventors: Zhanjun Gao, Rochester, NY (US); Jinquan Xu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/876,840

(22) Filed: Oct. 23, 2007

(51) Int. Cl.
*B41J 2/09* (2006.01)

(52) U.S. Cl. ..... 347/77

(58) Field of Classification Search ..... 347/77, 347/74–76, 78–82, 72–73, 9
See application file for complete search history.

(56) References Cited

U.S. PATENT DOCUMENTS 4,068,241 A 1/1978 Yamada
6,027,078 A 2/2000 Crouch et al.
6,457,807 B1 * 10/2002 Hawkins et al. ..... 347/40
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,863,384 B2 * 3/2005 Jeanmaire ..... 347/73

OTHER PUBLICATIONS

Dovgal et al., "Boundary Layer Control By a Local Heating of a Wall", IUTAM Laminar-Turbulent Transition, eds. D. Arnal and R. Michel, Springer-Verlag, pp. 113-121.
Tien et al., "Micro Heat Pipes", *Microscale Energy Transport*, published by Taylor & Francis 1998, pp. 295-337.
D. M. Rowe, *Thermoelectrics Handbook: Macro to Nano-Structured Materials*, published by CRC Press 2006.

* cited by examiner

*Primary Examiner*—K. Feggins
(74) *Attorney, Agent, or Firm*—William R. Zimmerli

(57) ABSTRACT

A method and printing system are provided. The printing system includes a liquid drop ejector, a fluid passage, and a fluid flow. The liquid drop ejector is operable to eject liquid drops having a plurality of volumes along a first path. The fluid passage includes a temperature gradient in the passage. The fluid flow source is operable to cause a fluid to flow in a direction through the passage, wherein interaction of the fluid flow and the liquid drops causes liquids drops having one of the plurality of volumes to begin moving along a second path.

23 Claims, 7 Drawing Sheets

PRINTER INCLUDING TEMPERATURE GRADIENT FLUID FLOW DEVICE

FIELD OF THE INVENTION

This invention relates generally to the management of gas flow and, in particular to the management of gas flow in printing systems.

BACKGROUND OF THE INVENTION

Printing systems incorporating a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops (traveling along a path) and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Turbulence reduction can be achieved by reducing the magnitude of disturbances and instability in the fluid flow. Local cooling has been theorized to be an effective technology for turbulence suppression. Cooling of a fluid flow surface cools the flow boundary layer which in turn will slow the development of turbulence instability. Local cooling to suppress turbulence was also experimentally demonstrated in Russia during 1980's. (See for example, Dovgal, Levchenko, and Timofeev, (1990) "Boundary layer control by a local heating of a wall," from IUTAM Laminar-Turbulent Transition, eds. D. Arnal and R. Michel, Springer-Verlag, pp. 113-121). U.S. Pat. No. 6,027,078, issued on Feb. 22, 2000, to J. D. Crouch and L. L. Ng, discloses aircraft boundary-layer flow control system incorporated a local heating for laminar flow.

However, one of the problems related to these types of turbulence reduction techniques is that each technique is concerned with external flow for an object, and thus can't be directly implemented in an internal flow through a channel that a printing system encounters.

Accordingly, a need exists to reduce turbulent gas flow in the gas flow drop interaction area of a printing system.

SUMMARY OF THE INVENTION

According to one aspect of the present invention, a printing system includes a liquid drop ejector, a fluid passage, and a fluid flow source. The liquid drop ejector is operable to eject liquid drops having a plurality of volumes along a first path. The fluid passage includes a wall with the wall including a first wall portion and a second wall portion. The second wall portion is located closer to the first path when compared to the location of the first wall portion. The first wall portion has a first temperature and the second wall portion has a second temperature with the second temperature being lower than the first temperature. The fluid flow source is operable to cause a fluid to flow in a direction through the passage. Interaction of the fluid flow and the liquid drops causes liquid drops having one of the plurality of volumes to begin moving along a second path.

According to another aspect of the present invention, a method of printing includes providing drops having a plurality of volumes traveling along a first path; causing a fluid to flow through a passage; creating a temperature gradient in the passage; and causing the fluid flow to interact with the liquid drops such that liquid drops having one of the plurality of volumes to begin moving along a second path.

According to another aspect of the present invention, a printing system includes a liquid drop ejector, a fluid passage, and a fluid flow. The liquid drop ejector is operable to eject liquid drops having a plurality of volumes along a first path. The fluid passage includes a temperature gradient in the passage. The fluid flow source is operable to cause a fluid to flow in a direction through the passage, wherein interaction of the fluid flow and the liquid drops causes liquid drops having one of the plurality of volumes to begin moving along a second path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
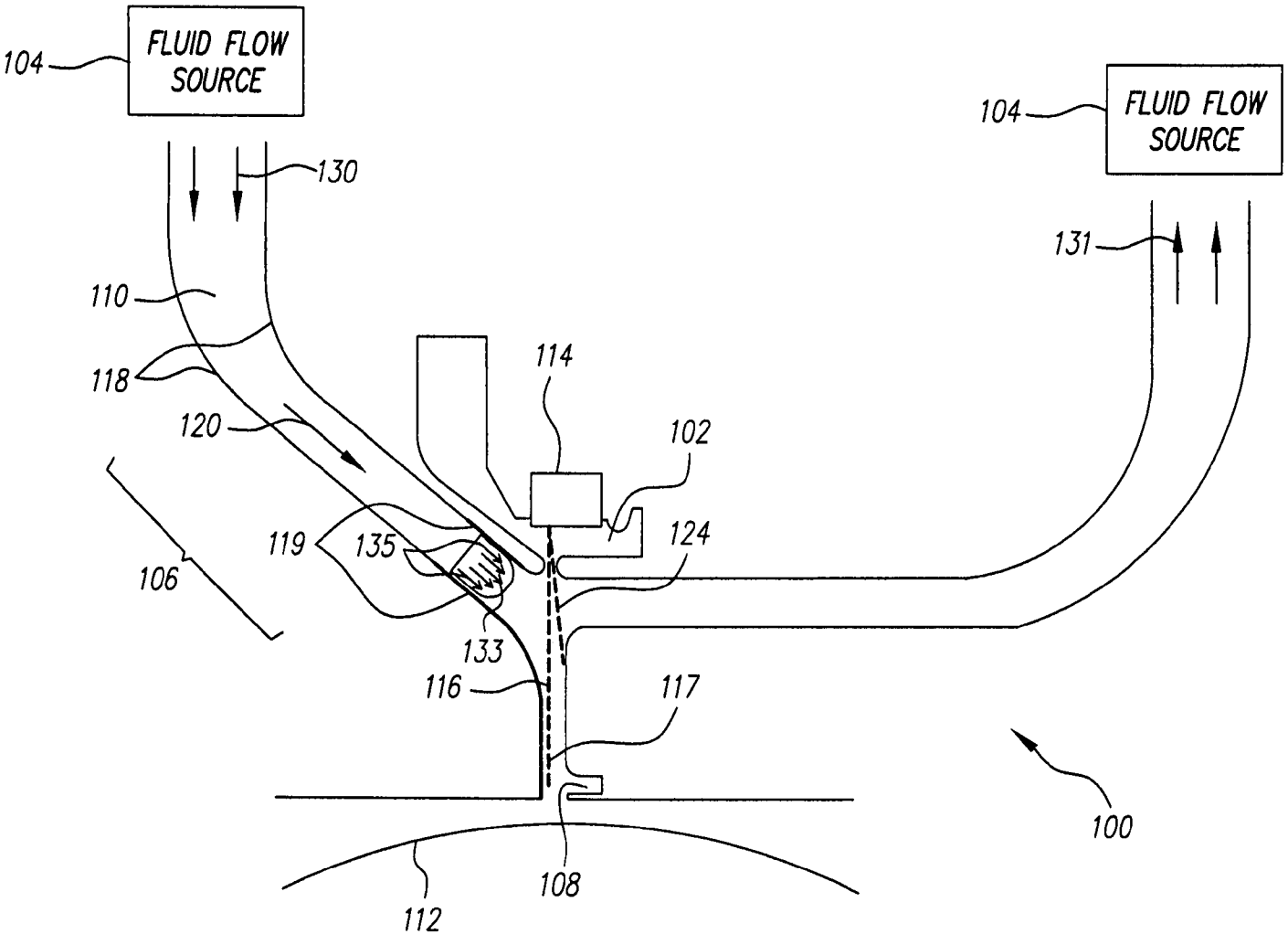
FIG. 1 is a schematic side view of a printing system with a fluid flow device incorporating an example embodiment of the present invention.

The present description will be directed in particular to elements forming part of, or cooperating more directly with, apparatus in accordance with the present invention. It is to be understood that elements not specifically shown or described may take various forms well known to those skilled in the art.

The example embodiments of the present invention are illustrated schematically and not to scale for the sake of clarity. One of ordinary skill in the art will be able to readily determine the specific size and interconnections of the elements of the example embodiments of the present invention.

In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

FIG. 1 is a schematic side view of a printing system with the fluid flow device incorporating an example embodiment of the present invention. The printing system 100 includes a printhead 102, a fluid flow device 106, a drop recycle system 108 and medium 112. The printhead 102 includes a drop forming mechanism 114 operable to form and eject liquid drops having a plurality of volumes traveling along a first path 116. The gas flow device 106 includes a first wall portion 118 and a second wall portion 119 that define a fluid passage 110. The second wall portion 119 is located closer to the first path 116 when compared to the location of the first wall portion 118. The first wall portion 118 and the second wall portion 119 can be straight or include a radius of curvature depending on the geometrical configuration of the printing system 100.

A fluid flow source 104 is operatively associated with the fluid passage 110 and is operable to cause a fluid flow (represented by arrows 120, hereafter) to flow through the fluid passage 110 along the first wall portion 118 and the second wall portion 119. The interaction of the fluid flow and the liquid drops causes liquid drops having one of the plurality of volumes diverge (or deflect) from the first path 116 and begin traveling along a second path 124 while liquid drops having another of the plurality of volumes remain traveling substantially along the first path 116 or diverge (deflect) slightly and begin traveling along a third path 117. Medium 112 is positioned along one of the first, second and third path while the drop recycle system 108 is positioned along another of the first, second or third paths depending on the specific application contemplated.

The fluid flow source 104 can be any type of mechanism commonly used to create a gas flow. For example, the fluid flow source 104 can be a positively pressured fluid flow source such as a fan or a blower operatively associated with an air front side 130 of the fluid passage 110. Alternatively, the fluid flow source 104 can be of the type that creates a negative pressure or a vacuum operatively associated with the air backside 131 of the fluid passage 110. Or, the fluid source 104 can be of the type that combines the positively pressured fluid flow source and the negative pressure source or a vacuum. The gas of the first fluid flow source 104 can be air, vapor, nitrogen, helium, carbon dioxide, or other, commonly available gases. However, one example of the gas of the first fluid flow source 104 is air. Often air is the preferred gas simply due to economical reasons.

Printheads like printhead 102 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; and U.S. Pat. No. 6,588,888 B2, issued to Jeanmaire et al., on Jul. 8, 2003. At least some of the liquid drops contact medium 112, such as paper or other medium, while other drops are collected by the drop recycle system 108 such as a catcher. Liquid drops received by the drop recycle system 108 are circulated through a liquid recirculation mechanism commonly available for reuse.

Referring to FIG. 1, the first wall portion 118 has a first temperature and the second wall portion 119 has a second temperature. It is preferred that the first temperature is higher than the second temperature. As the fluid flow flows through the fluid passage 110, the fluid flow is heated up by the higher temperature first wall portion 118, and then the heated fluid flow is cooled down by the lower temperature second wall portion 119. As the fluid flow flows over the first wall portion 118 and the second wall portion 119, a steady temperature gradient that is parallel to the fluid passage 110 can be formed in the fluid flow along the fluid passage 110. The fluid flow being cooled in the fluid passage 110 over the second wall portion 119 also includes a center region 133 and a boundary region 135. The temperature gradient in the fluid passage includes a temperature gradient that is normal to the fluid flow 120 such that the temperature is lower in a boundary region 135 of the fluid flow as compared to a center region 133 of the fluid flow.

The fluid flow at the air front side 130 of the fluid passage 110 can be any temperature that is suitable for a desired temperature gradient. The temperature of the fluid flow near the first path 116, however, should be controlled so that it is lower than the ink boiling point to avoid undesired intensive ink drop vaporization. For example, if the ink is aqueous-based, the temperature of the fluid flow 120 near the first path 116 should not exceed 100° C. Preferably, the temperature of the fluid flow near the first path 116 is close to ambient temperature to minimize adversary temperature effects on liquid drop forming mechanism 114. The temperature of the fluid flow near the first path 116 can be controlled by adjusting the first temperature of the first wall portion 118, and/or adjusting the second temperature of the second wall portion 119. A heating mechanism operatively associated with the first wall portion 118 can be configured to heat the first wall portion 118 to the first temperature. A cooling mechanism operatively associated with the second wall portion 119 can be configured to cool the second wall portion 119 to the second temperature. The first temperature and the second temperature should be adjusted according to the flow rate of fluid flow 120, and flow residual time in the fluid passage 110. Thermal sensing device such as temperature sensing resistors can be integrated into the first wall portion 118 and the second wall portion 119 to measure the temperatures of the walls. Non-intrusive thermal sensing device such as inferred thermal cameras can be used to monitor the temperature of the fluid flow if needed.

The materials for the first wall portion 118 and the second wall portion 119 can be tantalum, silicon, stainless steel, plastics, aluminum, nickel, or other composite materials, etc., depending on mechanical integrity and thermal property requirements. Generally it is preferred that the second wall portion 119 is made from a material having a higher effective thermal conductivity than that of the first wall portion 118. Materials with high coefficients of thermal expansion (CTE) should be avoided to minimize shape distortion of the first wall portion 118 and the second wall portion 119 that can be induced by the temperature gradient in the fluid passage 110.

Figure 2:
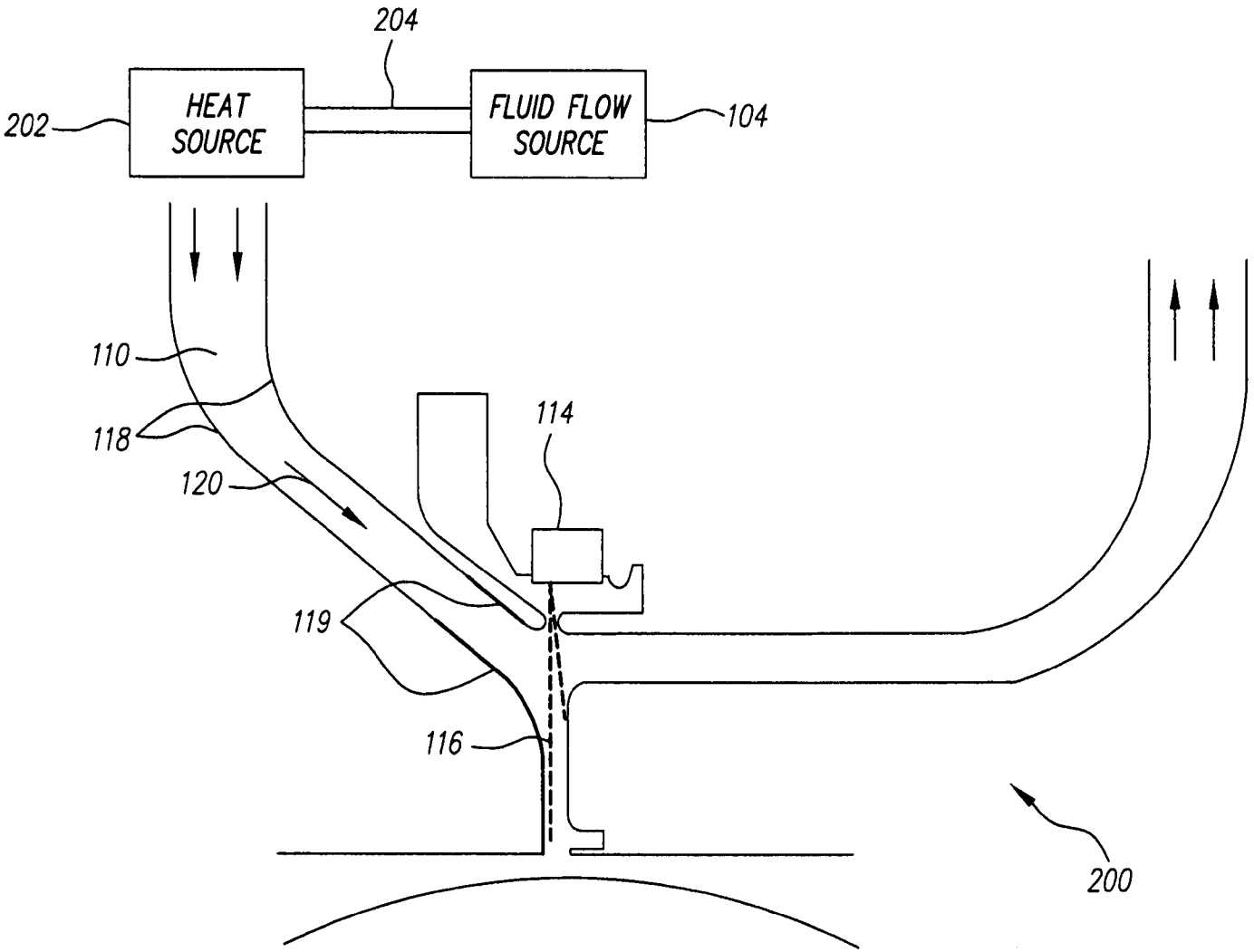
FIG. 2 is a schematic side view of a printing system with a fluid flow device incorporating another example embodiment of the present invention.

FIG. 2 is a schematic side view of a printing system with the fluid flow device incorporating another example embodiment of the present invention. The printing system 200 shown in FIG. 2 is similar to the printing system 100 shown in FIG. 1 with the recognition that applying a heat source 202 to heat up the fluid flow being pumped or sucked out from the fluid flow source 104. As an alternative of practice, the heat source 202 can also be placed upstream of the fluid flow source 104.

The fluid flow source 104 and the heat source 202 can be operatively connected by a fluid passage such as a pipe 204. The heat source 202 can be any kind heat source that is operatively associated with the fluid flow source 104 to heat up the fluid flow. For example, the heat source 202 can be an electrical stove, or a heat exchanger. The heat source 202 causes the temperature of the fluid flow to increase prior to the fluid flow entering the fluid passage 110. In the embodiment as shown in FIG. 2 with the heat source 202, the first wall portion 118 can or can not include a heating mechanism. For an embodiment that includes no heating mechanism in the first wall portion 118, low thermal conductivity material is desired for the first wall portion 118, in order to minimize heat dissipation through the first wall portion 118. The first wall portion 118 can also be wrapped with layers of thermal insulation materials for improved heat preservation purpose. Of course, the heat source 202 and a heating mechanism in the first wall portion 118 can coexist, but not necessary.

Figure 3B:
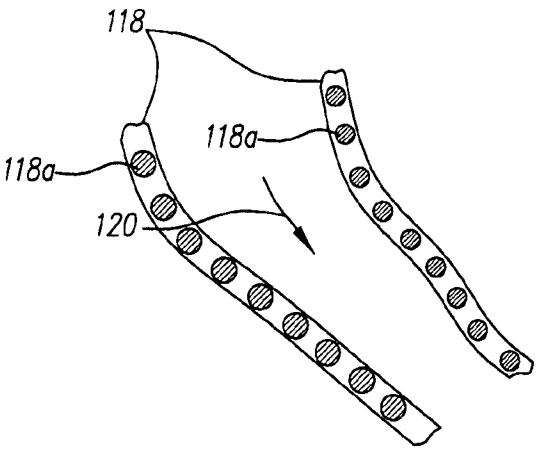
FIG. 3B is a portion of a gas flow device incorporating an embodiment of a heating apparatus of the present invention.
Figure 3C:
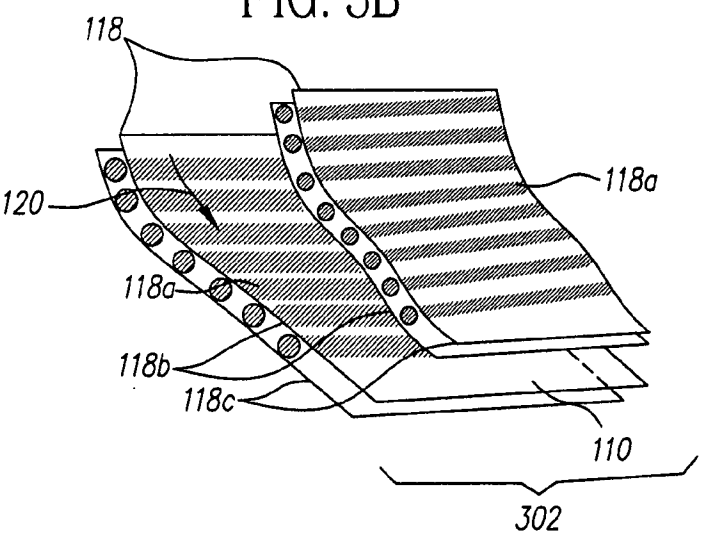
FIG. 3C is a schematic three-dimensional representation of the first wall portion with embedded electro-thermal heaters.
Figure 3A:
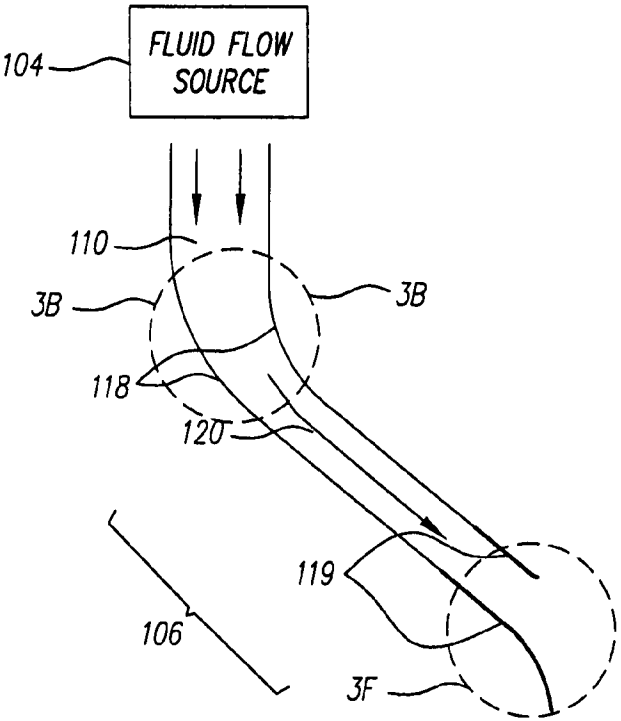
FIG. 3A is a schematic side view of a fluid flow device incorporating an example embodiment of the present invention.
Figure 3E:
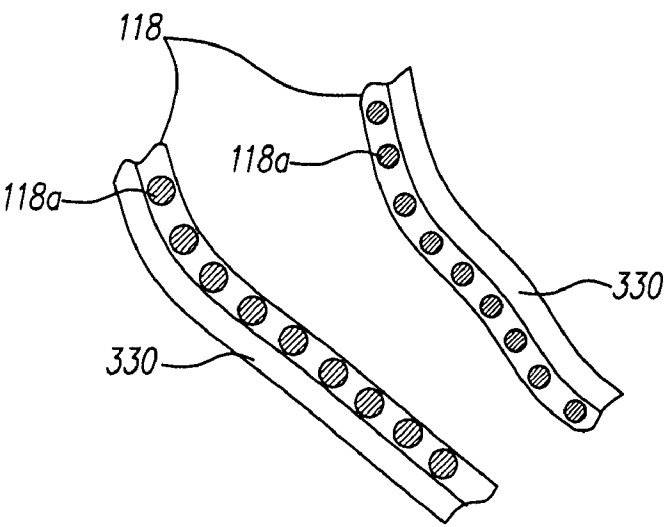
FIG. 3E is a portion of a gas flow device incorporating another example embodiment of the present invention.

FIG. 3A shows a portion of a gas flow device 106 that includes the first wall portion 118 and the second wall portion 119 defined the fluid passage 110. The fluid flow source 104 is operatively associated with the gas flow device 106. A heating mechanism is operatively associated with the first wall portion 118 to heat the first wall portion 118 to the first temperature, and a cooling mechanism is operatively associated with the second wall portion 119 to cool the second wall portion 119 to the second temperature. For clarity graphic presentations, a close-up representation of a portion of the first wall portion 118 is shown in FIG. 3B, and a close-up of a portion of the second wall portion 119 is shown in FIG. 3F, respectively.

Referring to FIG. 3B, the heating mechanism includes a structure, for example, a series of resistive electro-thermal heaters 118*a* operatively configured to the first wall portion 118 to heat the first wall portion 118 to the first temperature. The resistive electro-thermal heaters 118*a* include arrays of high electrical resistance wires embedded in the first wall portion 118. Resistive electro-thermal heaters are well known and as such are not discussed herein.

In one example embodiment, the electro-thermal heaters 118*a* are aligned parallel to each other and perpendicular to the fluid flow direction 120. FIG. 3C schematically shows a three-dimensional representation of the first wall portion 118 with such aligned electro-thermal heaters 118*a* embedded. Such parallel-aligned electro-thermal heaters 118*a* can substantially eliminate temperature nonuniformity across the width 320 of the flow passage 110. The electro-thermal heaters 118*a* can be embedded in the first wall portion 118, attached to the fluid flow side 118*b* of the first wall portion 118, or attached to the outer side 118*c* of the first wall portion 118. In the case of the electro-thermal heaters 118*a* being attached to the fluid flow side 118*b* of the first wall portion 118, the wall surface has to be polished very smooth to eliminate adversary effects any surface roughness may introduce to the fluid flow.

Figure 3D:
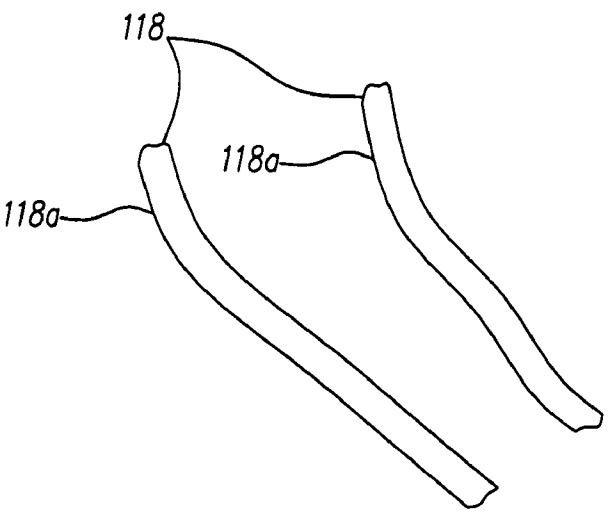
FIG. 3D is a portion of a gas flow device incorporating another embodiment of a heating apparatus of the present invention.

FIG. 3D shows another example embodiment of the electro-thermal heater 118*a*, in which the electro-thermal heater 118*a* is integrally formed with the first wall portion 118. For example, the first wall portion 118 is made from an electrically conductive metallic material. A direct current (DC) or an alternative current (AC) power source can be used to power the resistive electro-thermal heater 118*a*.

For the heat preservation purpose, the first wall portion 118 can also be wrapped with layers of thermal insulation materials. FIG. 3E shows a portion of the first wall portion wrapped with such a layer of thermal insulation material 330. The thermal insulation material 330 has a very low thermal conductivity and, typically, is not electrically conductive.

Referring to FIG. 3F, which is a close-up representation of a portion of the second wall portion 119 shown in FIG. 3A, the cooling mechanism includes a structure configured to sink heat away from the second wall portion 119 to cool the second wall portion 119 to the second temperature, and in turn sink heat away from the fluid flow 120. Typically, the second wall portion is made from a high thermal conductivity material to facilitate heat transfer. To make heat transfer even faster, as shown in FIG. 3F, the cooling structure can be micro heat pipes 119*c* located in the second wall portion 119. A micro heat pipe is a sealed vessel as a thermal conductance device. Working fluid phase is changed in heat pipe. The phase of working fluid at evaporator section (the fluid side 119*a* of the second wall portion 119) is changed from liquid to vapor and contrarily changed at condenser section (the outside wall 119*b* of the second wall portion 119) and cooled. Cooled working fluid is returned to from condenser to evaporator by capillary action within wick structure of the micro heat pipe. It dissipates energy from inside wall 119*a* of the second wall portion 119 by the latent heat of evaporation in a nearly isothermal operation. Working fluid is circulated inside heat pipe accompanying with the phase change at both evaporator and condenser. The working fluid is formed of a material such as ammonia, pentane or the like. The wick structure can be aluminum, stainless steel, nickel, and carbon composite, just as with most micro heat pipes. Details on micro heat pipes operating principles and its construction techniques can be found, for example, in Chapter Eight: "Micro Heat Pipes" (pp. 295-337) in the book "Microscale Energy Transport," edited by Tien, Majumdar and Gerner, published by Taylor & Francis in 1998. The micro heat pipes 119*c* embedded in the second wall portion 119 should be in high density and well aligned to ensure temperature uniformity across the width of the flow passage 110.

Figure 3G:
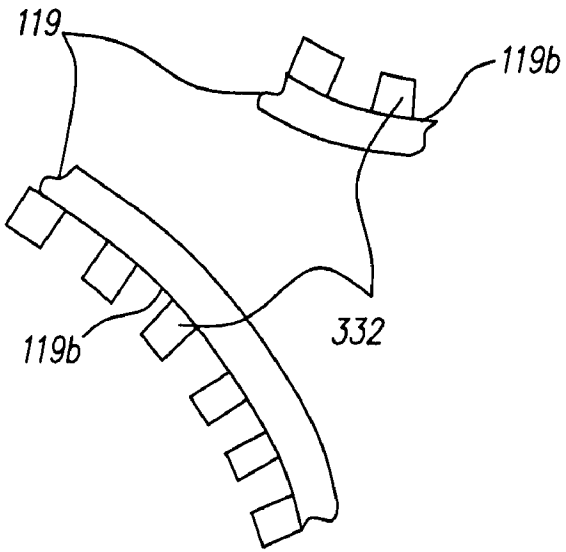
FIG. 3G is a portion of a gas flow device incorporating another example embodiment of the present invention.
Figure 3F:
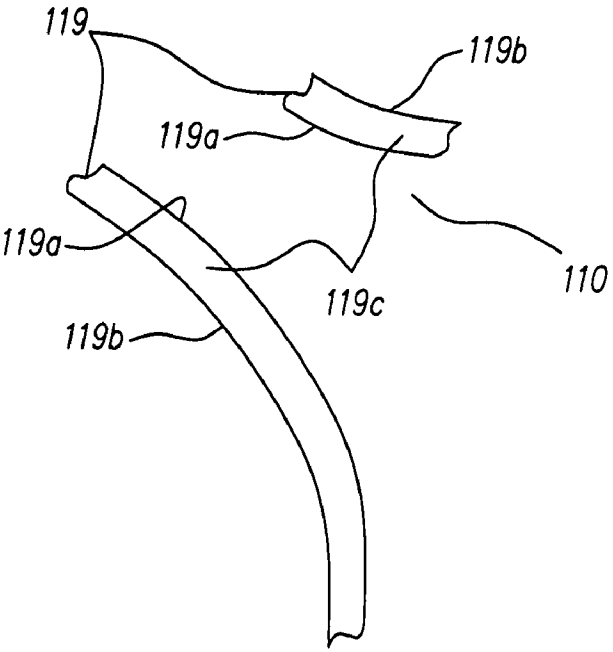
FIG. 3F is a portion of a gas flow device incorporating another example embodiment of the present invention.

FIG. 3G is another cooling mechanism operatively associated with the second wall portion 119 wherein cooling fins 332 are attached to the outer side 119*b* of the second wall portion 119. Cooling fins 332 are well known and as such are not discussed herein. It is preferred that the cooling fins are made from a material having high thermal conductivity.

Figure 3H:
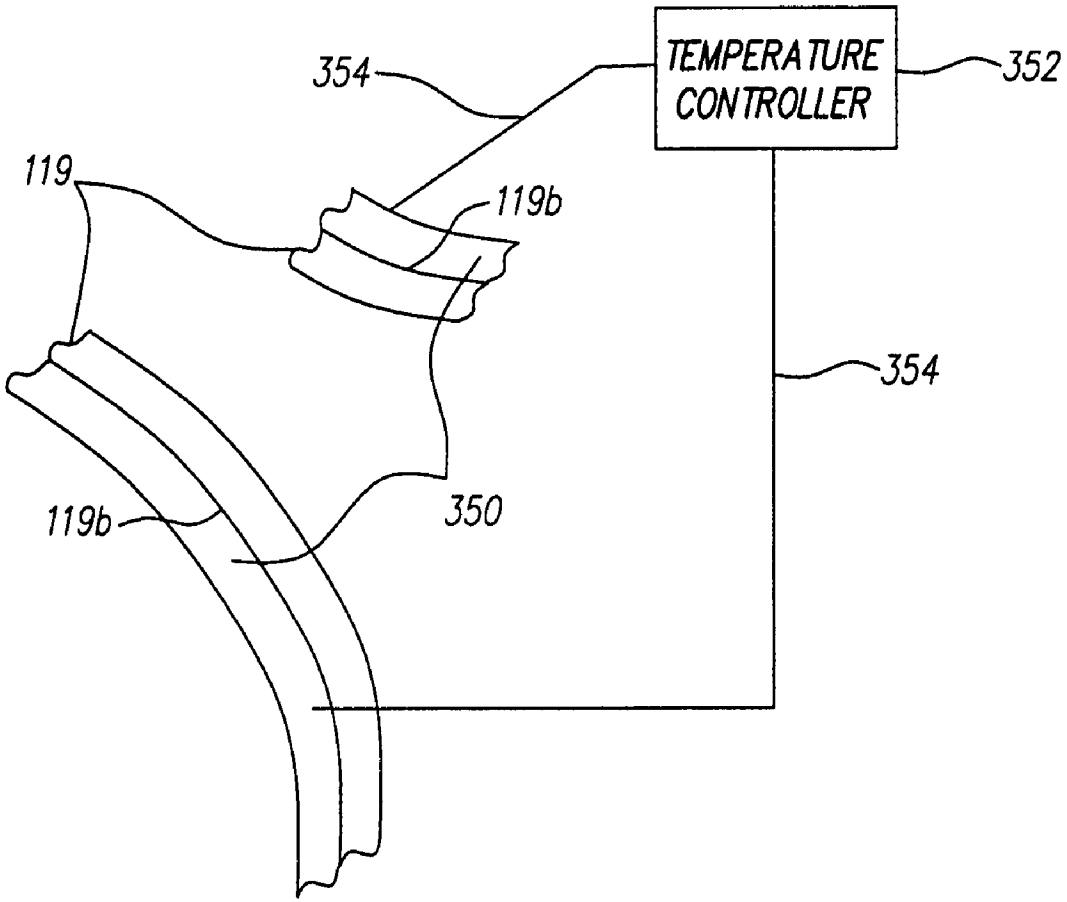
FIG. 3H is a portion of a gas flow device incorporating another example embodiment of the present invention.

FIG. 3H is another cooling mechanism operatively associated with the second wall portion 119 wherein thermoelectric cooling devices 350 are attached to the outer side 119*b* of the second wall portion 119. A temperature controller 352 is operatively associated with the thermoelectric cooling devices 350 via cable 354 to control the cooling effects of the thermoelectric cooling devices 350. The thermoelectric cooling device 350, (also known as Peltier devices, thermoelectric cooler) is a device in which a current is applied to a semiconductor causing a temperature reduction and cooling. Thermoelectric cooling devices are well known and as such are not discussed in detail herein. Details on thermoelectric cooling device operating principles, materials and its construction techniques can be found, for example, "Thermoelectrics Handbook: Macro to Nano-Structured Materials" edited by D. M. Rowe, published by CRC Press in 2006. Thermoelectric cooling devices are commercially available. The Thermoelectric cooling devices can also be custom-made to unusual size, a different performance parameter, an embedded sensor, and such. A known manufacturer of such thermoelectric cooling devices is Custom Thermoelectric, Inc.

Figure 4B:
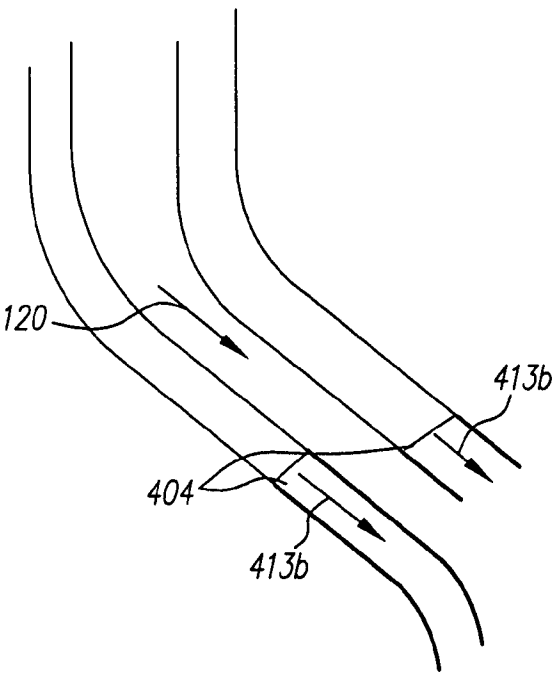
FIG. 4A is a portion of a gas flow device incorporating another example embodiment of the present invention; and, FIG. 4B is a portion of a gas flow device incorporating another example embodiment of the present invention.
Figure 4A:
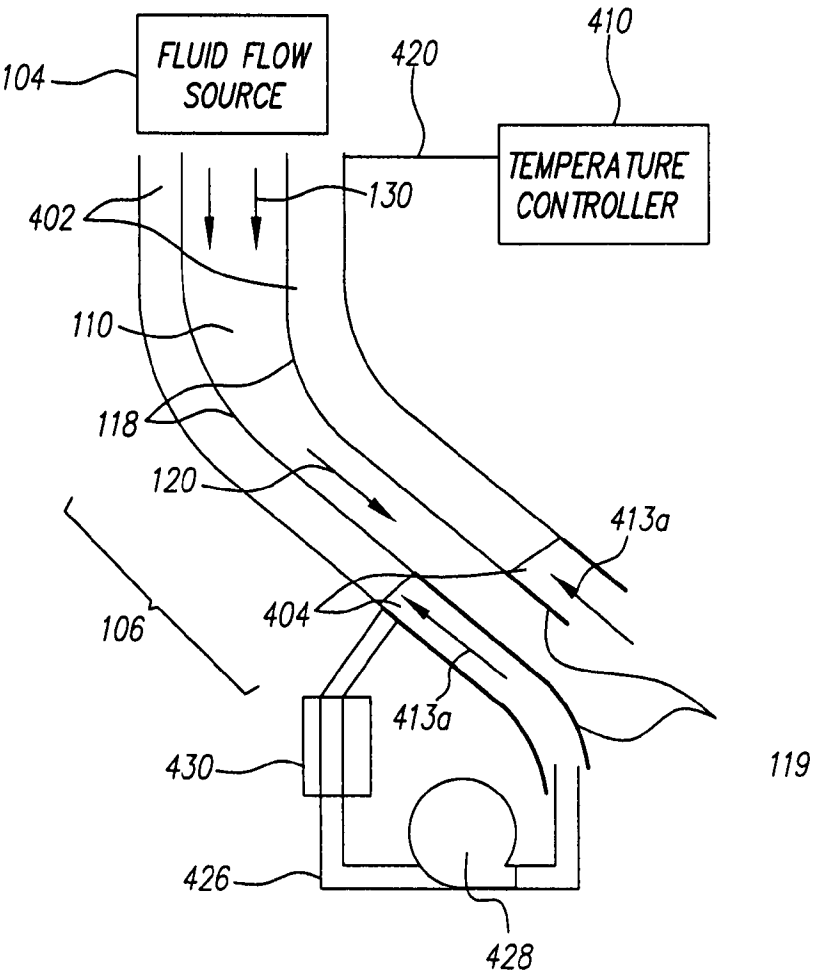

FIG. 4A is a portion of a gas flow device 106 that includes a first wall portion 118 and a second wall portion 119 defined a fluid passage 110. A fluid flow source 104 is operatively associated with the gas flow device 106. A heating mechanism is operatively associated with the first wall portion 118 to heat the first wall portion 118 to the first temperature, and a cooling mechanism is operatively associated with the second wall portion 119 to cool the second wall portion 119 to the second temperature. Referring to FIG. 4A, the heating mechanism includes a heated fluid flow 402 that heats the first wall portion 118 to the first temperature. The heated fluid flow 402 can be static constant-temperature hot liquid bath electrically controlled by a temperature controller 410 through a conductive path 420. The temperature controller 410 can turn on/off a power source to maintain the hot liquid bath at a constant preset temperature, such as the preferred first temperature of the first wall portion 118. The fluid can be ink, water, air, oil, etc., depending on specific temperature requirement for each heating application. For example, if the temperature of the first wall portion 118 is lower than 100° C., the heated fluid flow can be ink or water; if the temperature of the first wall portion 118 exceeds 100° C., then high boiling point oils can be used for the heating purpose. The heated fluid flow can also be flowing fluid, but this is not preferred.

Still referring to FIG. 4A, the cooling mechanism includes a cooled fluid flow 404 that cools the second wall portion 119 to the second temperature. The cooled fluid flow 404 can be flowing cold fluid, for example, cold ink, water, oil, or air. A heat dissipation mechanism 430, such a heat exchanger, is operatively associated with the cooled fluid flow 404 to cool the fluid, and a mass transfer mechanism 428, for example a fluid pump, is operatively associated with the cooled fluid flow 404 and the heat dissipation mechanism 430 through fluid channel 426 to drive the cooled fluid flow 404 flowing over the second wall portion 119. The cooled fluid flow 404 can flow in a direction 413*a* against the fluid flow 120; or the cooled fluid flow 404 can flow in a direction 413*b* parallel to the fluid flow 120 as shown in FIG. 4B.

The cooling mechanism sinks heat away from the second wall portion 119 to the second temperature and in turn cools the fluid flow 120 in the flow passage 110. With the heating mechanism and the cooling mechanism inactive, a temperature gradient can form in the fluid passage. The cooling fluid 404 either flows in a direction 413*a* against or opposite the fluid flow direction 120, or in a direction 413*b* parallel to the fluid flow direction 120 to ensure temperature uniformity across the width of the flow passage 110. Attentions have to be paid to ensure that little or no vibration is introduced to the gas flow device 106 should a mass transfer mechanism 428 be used in the system. The cooled fluid flow can also be a static constant-temperature fluid bath controlled by a temperature controller and connected to a heat dissipation mechanism such as a heat exchanger.

It is preferred that the heating and cooling activities occur concurrently and continuously to achieve a desired temperature gradient in the fluid passage 110. However, obviously it is acceptable to create the temperature gradient in the fluid passage 110 by heating the first wall portion only, or, by cooling the second wall portion only, or by pre-heating the fluid flow only, or by combining any of these approaches.

The invention has been described in detail with particular reference to certain example embodiments thereof, but it will be understood that variations and modifications can be effected within the scope of the invention.

PARTS LIST

100 printing system
102 printhead
104 fluid flow source
106 fluid flow device
108 drop recycle system
110 fluid flow passage
112 medium
114 mechanism
116 first path
117 third path
118 first wall portion
118*a* resistive electro-thermal heater
118*b* fluid flow side
118*c* outer side
119 second wall portion
119*a* inside wall
119*b* outside wall
119*c* micro heat pipes
120 fluid flow direction
124 second path
130 air front side
131 air backside
133 center region
135 boundary region
200 printing system
202 heat source
204 pipe
320 width
330 thermal insulation material
332 cooling fins
350 thermoelectric cooling devices
352 temperature controller
354 cable
402 heated fluid flow
404 cooled fluid flow
410 temperature controller
413*a* direction
413*b* direction
420 conductive path
426 fluid channel
428 mass transfer mechanism
430 heat dissipation mechanism

The invention claimed is:

1. A printing system comprising:

a liquid drop ejector operable to eject liquid drops having a plurality of volumes along a first path;

a fluid passage including a wall, the wall including a first wall portion and a second wall portion, the second wall portion being located closer to the first path when compared to the location of the first wall portion, the first wall portion having a first temperature, the second wall portion having a second temperature, the second temperature being lower than the first temperature; and a fluid flow source operable to cause a fluid to flow in a direction through the passage, wherein interaction of the fluid flow and the liquid drops causes liquids drops having one of the plurality of volumes to begin moving along a second path.

2. The system of claim 1, further comprising:

a heating mechanism associated with the first wall portion, the heating mechanism being configured to heat the first wall portion to the first temperature.

3. The system of claim 2, further comprising:

a thermal insulation material wrapped around the first wall portion.

4. The system of claim 2, wherein the heating mechanism includes a resistive electro-thermal heater attached to the first wall portion.

5. The system of claim 4, wherein the resistive electro-thermal heaters are parallel to each other and perpendicular to the fluid flow.

6. The system of claim 2, wherein the resistive electrothermal heater is integrally formed with the first wall portion.

7. The system of claim 2, wherein the heating mechanism includes a heated fluid flow that heats the first wall portion.

8. The system of claim 1, further comprising:

a cooling mechanism associated with the second wall portion, the cooling mechanism being configured to cool the second wall portion to the second temperature.

9. The system of claim 8, wherein the cooling mechanism includes a structure configured to sink heat away from the second wall portion.

10. The system of claim 9, wherein the cooling mechanism structure includes a fin attached on the outside wall of the second wall portion.

11. The system of claim 9, wherein the cooling mechanism structure includes a cooled fluid flow that cools the second wall portion.

12. The system of claim 11, wherein the cooling mechanism structure is positioned such that the cooled fluid flows either parallel to the fluid flow through the fluid passage or against the fluid flow through the fluid passage.

13. The system of claim 9, wherein the cooling mechanism structure includes one of a micro-heat pipe and a thermoelectric cooling device located in the second wall portion.

14. The system of claim 1, wherein the fluid flow source includes a device that pre-heats the fluid.

15. The system of claim 1, wherein the second wall portion is made from a material having a higher effective thermal conductivity than that of the first wall portion.

16. A method of printing comprising:

providing drops having a plurality of volumes traveling along a first path;

causing a fluid to flow through a passage;

creating a temperature gradient in the passage; and causing the fluid flow to interact with the liquid drops such that liquid drops having one of the plurality of volumes to begin moving along a second path.

17. The method of claim 16, the passage including a first portion and a second portion, the second portion being located closer to the first path when compared to the location of the first portion, wherein creating the temperature gradient in the passage includes heating the first portion of the passage.

18. The method of claim 17, wherein creating the temperature gradient in the passage includes cooling the second portion of the passage.

19. The method of claim 16, the passage including a first portion and a second portion, the second portion being located closer to the first path when compared to the location of the first portion, wherein creating the temperature gradient in the passage includes cooling the second portion of the passage.

20. The method of claim 16, further comprising:

pre-heating the fluid flow.

21. The method of claim 16, wherein creating the temperature gradient in the passage includes creating a temperature gradient that is parallel to the passage such that the temperature of the passage decreases as the fluid flow moves closer to the first path.

22. The method of claim 16, the fluid flow including a center region and a boundary region, wherein creating the temperature gradient in the passage includes creating a temperature gradient that is normal to the fluid flow such that the temperature is lower in a boundary region of the fluid flow as compared to a center region of the fluid flow.

23. A printing system comprising:

a liquid drop ejector operable to eject liquid drops having a plurality of volumes along a first path;

a fluid passage including a temperature gradient in the passage; and a fluid flow source operable to cause a fluid to flow in a direction through the passage, wherein interaction of the fluid flow and the liquid drops causes liquids drops having one of the plurality of volumes to begin moving along a second path.

* * * * *